US009890605B2

(12) United States Patent
Juhlin et al.

(10) Patent No.: US 9,890,605 B2
(45) Date of Patent: Feb. 13, 2018

(54) DEVICE FOR COLLECTION OF PARTICULATE MATERIAL IN A CONDUIT

(71) Applicant: Altus Intervention AS, Stavanger (NO)

(72) Inventors: Rasmus Juhlin, Stavanger (NO); Lasse Haugland, Bryne (NO)

(73) Assignee: Altus Intervention AS, Stavanger (NO)

( * ) Notice: Subject to any disclaimer, the term of this patent is extended or adjusted under 35 U.S.C. 154(b) by 461 days.

(21) Appl. No.: 14/421,499

(22) PCT Filed: Aug. 20, 2013

(86) PCT No.: PCT/NO2013/050132

§ 371 (c)(1),
(2) Date: Feb. 13, 2015

(87) PCT Pub. No.: WO2014/031006

PCT Pub. Date: Feb. 27, 2014

(65) Prior Publication Data

US 2015/0218901 A1 Aug. 6, 2015

(30) Foreign Application Priority Data

Aug. 21, 2012 (NO) ..... 20120934

(51) Int. Cl.
*E21B 27/00* (2006.01)
*E21B 43/08* (2006.01)
(Continued)

(52) U.S. Cl.
CPC ..... *E21B 27/005* (2013.01); *E21B 43/084* (2013.01); *E21B 43/088* (2013.01); *E21B 43/128* (2013.01); *E21B 49/086* (2013.01)

(58) Field of Classification Search
CPC .... E21B 27/005; E21B 43/084; E21B 43/088; E21B 43/128; E21B 49/086
See application file for complete search history.

(56) References Cited

U.S. PATENT DOCUMENTS 1,362,775 A 12/1920 Bunker
2,909,225 A * 10/1959 Hanes ..... E21B 27/00 166/162

(Continued)

FOREIGN PATENT DOCUMENTS

WO 95/03870 2/1995

*Primary Examiner* — Daniel P Stephenson
(74) *Attorney, Agent, or Firm* — Gable Gotwals

(57) ABSTRACT

This invention relates to a movable collecting device (1) for downhole separation and removal of particulate matter (8) from a petroleum well, the collecting device (1) having a first end portion (11) and a second end portion (12), an exterior and an interior; the collecting device (1) comprising an outer wall (4) extending axially from the first end portion (11) and to the second end portion (12), a portion of the wall (4) surrounding a collecting chamber (5); a nose (2) at the first end portion (11) comprises at least one external inlet (23), the external inlet (23) being in fluid communication with the collecting chamber (5); a drive unit (3) positioned at the second end portion (12); and a means (6) for transporting the particulate matter (8) from the exterior of the collecting device (1) to the interior of the collecting device (1) through the external inlet (23), and a portion of the wall (4) comprises a screen in fluid communication with the collecting chamber (5) and the collecting device's (1) exterior. Use of a screen (40) to form at least a portion of a wall (4) surrounding a collection chamber (5) in a movable collection device (1) is described as well.

22 Claims, 2 Drawing Sheets

Figure 1:
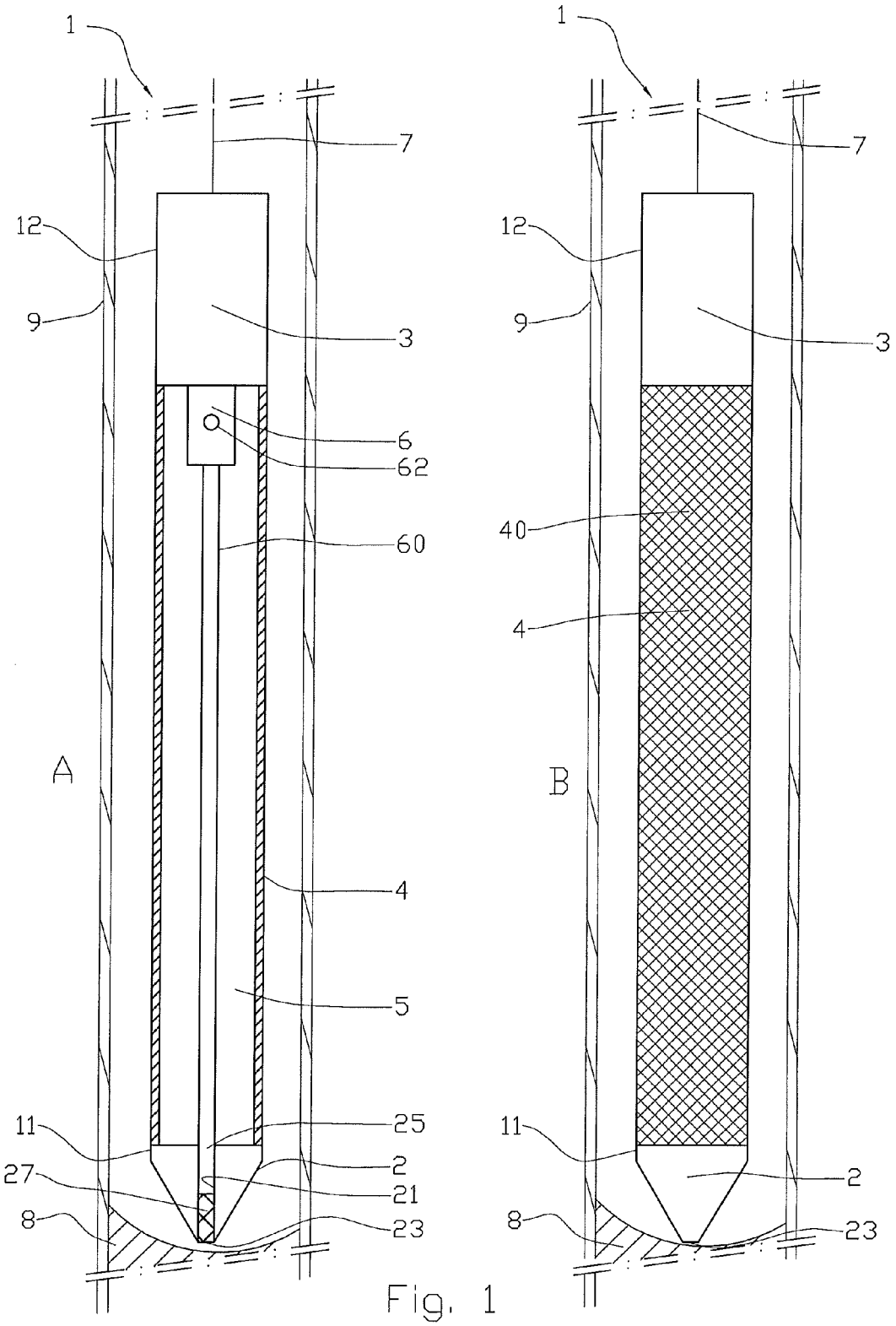

(51) Int. Cl.
*E21B 43/12* (2006.01)
*E21B 49/08* (2006.01)

(56) References Cited

U.S. PATENT DOCUMENTS

| | | | | |
|---|---|---|---|---|
| 4,101,172 | A * | 7/1978 | Rabbitts | E21B 43/24 166/271 |
| 5,810,084 | A * | 9/1998 | Echols | E21B 17/06 166/242.7 |
| 6,158,512 | A * | 12/2000 | Unsgaard | E21B 37/08 166/105.1 |
| 6,263,970 | B1 | 7/2001 | Blanchet | |
| 6,569,814 | B1 * | 5/2003 | Brady | C09K 8/52 507/201 |
| 7,080,686 | B2 * | 7/2006 | Beckhardt | E21B 27/00 137/205 |
| 2003/0145990 | A1 | 8/2003 | Longacre | |
| 2004/0089446 | A1 * | 5/2004 | Sugden | E21B 37/10 166/227 |
| 2009/0008085 | A1 * | 1/2009 | Roaldsnes | B01D 29/111 166/233 |
| 2015/0218901 | A1 * | 8/2015 | Juhlin | E21B 43/088 166/105.1 |

* cited by examiner

DEVICE FOR COLLECTION OF PARTICULATE MATERIAL IN A CONDUIT

CROSS-REFERENCE TO RELATED APPLICATIONS

This is the United States National Phase of PCT Application No. PCT/NO2013/050132 filed 20 Aug. 2013 which claims priority to Norwegian Patent Application No. 20120934 filed 21 Aug. 2012, each of which are incorporated herein by reference.

BACKGROUND OF THE INVENTION

The invention relates to separation and removal of settled material in a petroleum production well. More particularly, the invention relates to a movable collecting device which separates the material downhole, retains particulate material within the collecting device and brings the particulate material to the surface on return of the collecting device.

In the petroleum industry it is well known that production wells may produce sand together with oil and gas. There are several reasons for sand production, among other things that the petroleum reservoir is less consolidated than assumed or that the production rate is too high. Sand production causes several problems. Sand grains in a fluid act as an abrasive and may erode pipes and valves. Formation damage is another problem associated with sand producing wells. In general a sand producing well may reduce the production rate.

To overcome or at least to reduce problems associated with sand production, several methods are known. One method is use of screens or slotted liners and screens. One type of screen is known as wire-wrapped screen. A wire-wrapped screen consists of keystone-shaped, corrosion resistant wire wrapped helically into a circular shape. The wire is welded to several axial rods arranged around the inside circumference of the screen. The wire-wrapped screen may be welded to the surface of a slotted liner, forming a pipe-base wire-wrapped oil well screen. It is also known to use two concentric wire-wrapped screens one on the outside of the other. The annulus between the wire-wrapped screens may be packed with gravel-packed sand. This is termed dual-wrapped pre-packed well screen.

The keystone-shaped wire is circular wrapped with the widest portion facing outwards of the screen and the narrowest portion facing inwards. Thereby a tapered slot is formed between two consecutive wires. The smallest axial distance between two consecutive wires is in the industry expressed in units of 0.001 in (0.0254 mm). The unit is referred to as the gauge of the screen. A 6-gauge screen will have a space between the wires of 0.006 in (0.15 mm).

Another type of screen is a premium screen. A premium screen uses a woven metal cloth.

In the following description the size ranges defined in the Udden-Wentworth scale is used. Clay particles are less than 0.004 mm (0.00015 in) in size and silt particles are between 0.004 mm and 0.0625 mm (0.0015-0.0025 in) in size. In comparison very fine sand particles are between 0.0625 and 0.125 mm (0.0025-0049 in) in size and fine sand particles are between 0.125 and 0.25 mm (0.0049-0.010 in) in size. According to ISO 14688-1 clay particles are less than 0.002 mm in size.

It is common to classify petroleum wells into:

Conventional wells where maximum angular deviation away from the vertical direction is about 65°

Extended Reach Drilled (ERD) where the angular deviation away from the vertical direction is larger than 65°

Horizontal wells where portion of the wells demonstrate an angular deviation about 90° away from the vertical direction.

Some wells are not provided with sand screens. In a number of sand producing wells, sand is efficiently kept out of the production tubing by screens. However, screens will not prevent migration of fine material as silt and clay from the reservoir and into the production tubing. Silt and clay will follow the petroleum stream, or will settle out. In deviated, and especially in highly deviated and horizontal wells, such settled material will build up and choke or at least partially choke the production tubing. Even in smaller amounts such debris or settled material may obstruct maintenance work such as wire line operations. Thereby it is not possible to place the intervention tools in the desired position.

The deposit will due to the gravitational force build up from the "6 o'clock" position inside the production tubing and have a lengthy shape.

It is known to remove settled fine material or deposit by use of coiled tubing intervention. This is a time consuming and an expensive task as coiled tubing equipment must be mobilized.

Wire line tractors are known in the petroleum industry for their ability to perform tasks in deviating and horizontal wells due to their built-in propulsion mechanism. Wire line tractors are provided with interchangeable well intervention equipment. Patent NO 331293 discloses a collecting device to be pushed in a deviating or horizontal production pipe by a wire line tractor. Settled sand is loosened by a front scraper and transported into the collecting device by a feed screw. When filled, the collecting device is returned to the surface for emptying.

In contrast to sand, fine particular debris as clay and silt will not settle rapidly after being whirled up. Known collecting devices will not effectively remove clay and silt from oil producing wells, as a major part of the collected material will be liquid. After being whirled up, silt will settle slowly while clay will remain suspended for a considerable time. Suspended clay is difficult to separate out by conventional filtering techniques.

The invention has for its object to remedy or reduce at least one of the drawbacks of the prior art or at least provide a useful alternative to the prior art.

The object is achieved through features which are specified in the description below and in the claims that follow.

In a first aspect, the invention relates to a movable collecting device for downhole separation and removal of particulate matter from a petroleum well, the collecting device having a first end portion and a second end portion, an exterior and an interior; the collecting device comprising:

- an outer wall extending axially from the first end portion and to the second end portion, a portion of the wall surrounding a collecting chamber;
- a nose at the first end portion comprising at least one external inlet, the external inlet being in fluid communication with the collecting chamber;
- a drive unit positioned at the second end portion; and
- a means for transporting the particulate matter from the exterior of the collecting device to the interior of the collecting device through the external inlet; and
- a portion of the wall comprising a screen in fluid communication with the collecting chamber and the exterior of the collecting device.

The particulate matter may comprise silt, sand or a mixture of silt and sand. The particulate matter may in addition be mixed with clay. The particulate matter may be deposited in a petroleum producing well, and more particularly in the production tubing of the well. The well may be a vertical well, a horizontal well or a deviating well.

The means for transporting the particulate matter into the collection device may be a pump. The external inlet may be in fluid communication with the suction side of the pump and the collecting chamber may be in fluid communication with the pressure side of the pump. An axial conduit may form the fluid communication between the external inlet and the suction side of the pump. The conduit may be a tube.

At its first end portion the collecting device may in an alternative embodiment further comprise a closed coarse debris container which may be in fluid communication with the external inlet through a check valve, and the coarse debris container may be in fluid communication with the suction side of the pump. An axial conduit may provide for the fluid communication between the coarse debris container and the pump's suction side. The conduit may be a tube. A free end portion of the conduit may extend into the coarse debris chamber from the collecting chamber through a partition wall between the collecting chamber and the coarse debris chamber. The free end portion of the conduit may be surrounded by a coarse filter.

The screen may substantially form the wall surrounding the collecting chamber in the first embodiment. The screen may substantially form the wall extending from the coarse debris chamber and to the drive unit in the alternative embodiment. The screen may be a wire-wrapped screen or a premium screen.

In a second aspect, the invention relates to a use of a screen to form at least a portion of a wall surrounding a collecting chamber in a movable collecting device. In an alternative embodiment the screen may substantially form the wall. The screen may be a wire-wrapped screen or a premium screen.

In what follows, examples of preferred embodiments are described, which are visualized in the accompanying drawings, in which:

FIG. 1A-B shows a schematic partly cross section of a collecting device according to the invention in a production tubing, and a schematic side view of the device, respectively; and FIG. 2A-B shows a schematic partly cross section of a collecting device according to a second embodiment of the invention in a production tubing, and a schematic side view of the device, respectively.

The collecting device according to the invention is provided with at least two different types of filters. One filter type is a coarse filter type structured in a manner allowing it to restrain sand while silt and clay may pass. A second filter is a fine filter type structured in a manner allowing it to restrain silt while clay may pass.

In the figures, the reference numeral 1 indicates a collecting device in accordance with the invention. The collecting device 1 is shown positioned in a production tubing 9.

The production tubing 9 is shown as a vertical tubing, but the collection device 1 is designed to work movably in production tubings 9 having an inclination between vertical and horizontal direction. In an inside portion of the production tubing 9 there is a deposit of settled material 8. The settled material 8 may comprise silt, sand or a mixture of silt and sand. The settled material 8 may in addition contain clay.

The collecting device 1 forms a first end portion 11 and a second end portion 12. The collecting device 1 comprises a nose 2 at the first end portion 11, a drive unit 3 at the second end portion 12, and a wall 4 extending from the nose 2 to the drive unit 3. A collecting chamber 5 is formed inside the wall 4. The collecting chamber 5 is closed at the first end portion 11 by the nose 2, and at the second end portion 12 by the drive unit 3. The drive unit 3 houses a motor (not shown) of a type known per se and the internal static pressure of the drive unit 3 is kept above ambient pressure to avoid gas ingress as known in the art.

The nose 2 is provided with at least one through bore 21 which forms an external inlet 23 and an internal outlet 25. The bore 21 is provided with a filter 27. A pump 6 is positioned at the second end portion 12 in the collecting chamber 5. The pump 6 is powered by the drive unit 3 and the pump 6 is of a type known per se. An axial conduit 60 extends inside the collecting chamber 5 between the pump 6 and the internal outlet 25. In the embodiment shown the conduit 60 is constituted by a pipe. The pump 6 is provided with at least one outlet 62 flowing into the collecting chamber 5.

The wall 4 comprises at least in a portion a screen 40 of a type known per se. In the embodiment shown in FIG. 1, the entire wall 4 is constituted by a screen 40. The screen 40 may be a premium screen or a wire-wrapped screen or other types of screens of sufficient stiffness and rigidity suitable for the purpose. A wire-wrapped screen of gauge 1 or gauge 2 is an example of a suitable screen 40. A one layer premium screen with a mesh size adapted to restrain silt is another example of a suitable screen 40. The screen 40 may comprise two or more layers of premium screens. The premium screens 40 may be of different mesh sizes.

At the second end portion 12 the collecting device 1 is provided with a cable 7. The cable 7 is an electric cable/wire line cable of a type known per se. The electric cable 7 provides electrical energy to the motor in the drive unit 3, and the collecting device 1 may be pulled out of the production tubing by the cable 7. In an alternative embodiment the collecting device 1 is pushed downwards or pulled upwards by a wire line tractor (not shown) in a way well known to the skilled person. The wire line tractor may also provide energy for the drive unit 3.

The collecting device 1 is structured in manner allowing the pump 6 to be started when the collecting device 1 hits or encounters the settled material 8. The pump 6 is in fluid communication with the inlet 23 through the conduit 60 and the bore 21. Thereby settled material 8 is sucked into the bore 21 through the filter 27 and the material 8 continues through the conduit 60 towards the pump 6. After passing the pump 6, the material 8 is expelled from the pump 6 at the pressure side through the pump outlet 62. The material 8 flows into the collecting chamber 5. Due to the filtering effect of the screen 40 in the wall 4, the silt part of the material 8 is retained within the collecting chamber 5, while the liquid fraction and suspended clay that followed the material 8 into the pump 6, passes through the screen 40 in the wall 4. Due to the liquid in the collecting chamber 5 being on the pressure side of the pump 6, the static pressure inside the collecting chamber 5 is higher than the ambient static pressure.

The filter 27 is a pre-filter/coarse filter which prevents larger particles and sand to enter into the pump 6 and the collecting chamber 5.

When the collecting chamber 5 is filled up with material 8, the collecting device 1 is retrieved to the surface for emptying. The collecting device 1 is also retrieved to the surface for emptying when the settled material 8 has been removed from the production tubing 9 and other operations may be carried out.

Figure 2:
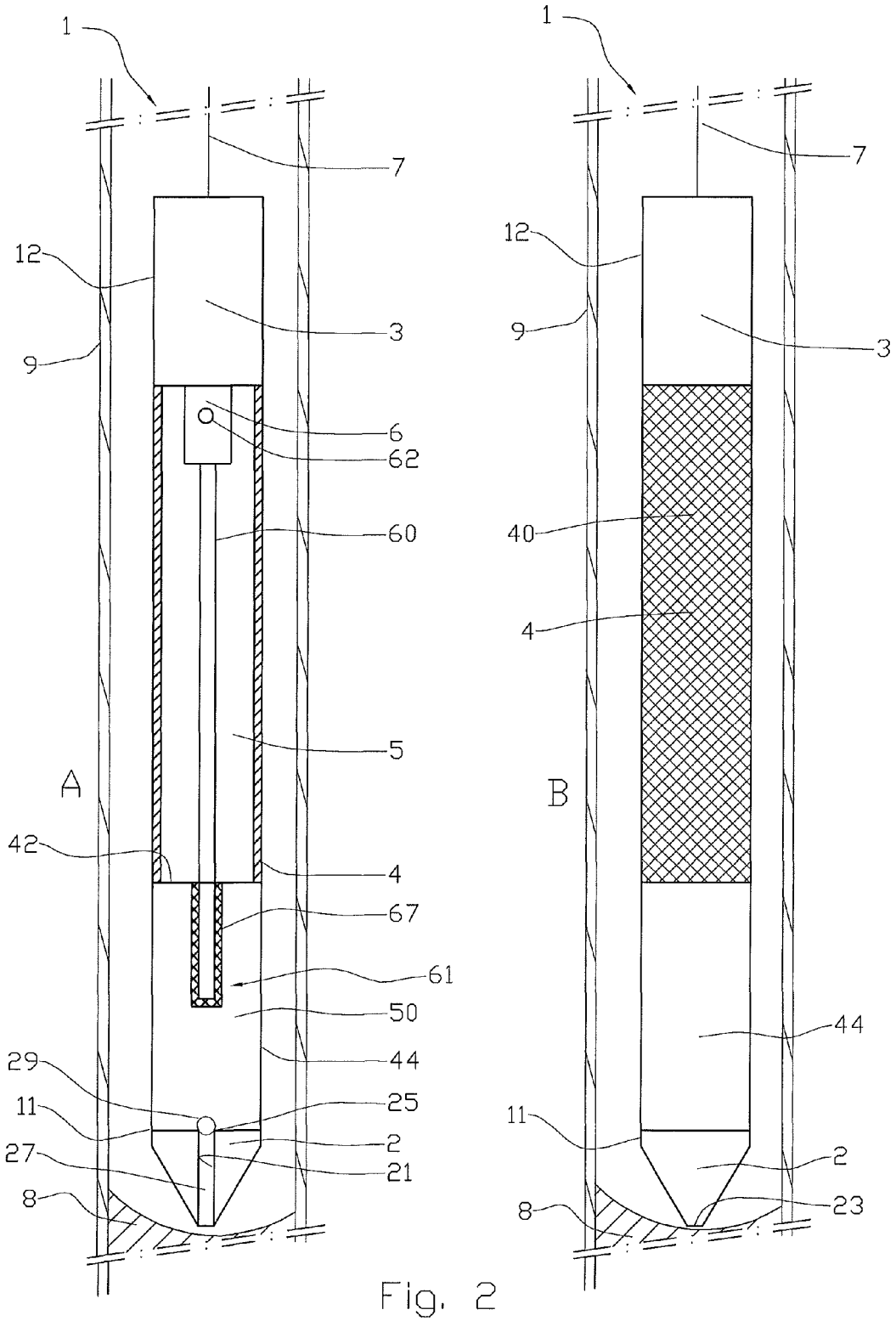

A second embodiment of the invention is shown in FIG. 2. Only differences between the embodiments are discussed. Same elements have the same reference numerals.

The first end portion 11 is provided with a closed circular wall 44 which extends axially between the nose 2 and the wall 4. The wall 44 forms a coarse debris container 50 which is closed at the nose 2 and with a circular partition wall 42 between the collecting chamber 5 and the coarse debris collector 50. The internal outlet 25 is positioned at the first end portion 11 of the coarse debris container 50 and a check valve 29 connects the through bore 21 with the coarse debris container 50. A free end portion 61 of the conduit 60 extends into the coarse debris container 50 through the partition wall 42 from the collecting chamber 5. The free end portion 61 is provided with a plurality of holes or slots (not shown). The free end portion 61 is surrounded by a coarse filter 67.

The suction action of the pump 6 will make material 8 to pass the check valve 29 and into the closed coarse debris chamber 50. Coarse particles (not shown) such as sand in the material 8 will be retained by the coarse filter 67 and remain in the coarse debris chamber 50 as the coarse material cannot return through the check valve 29. Material 8 that passes the coarse filter 67 into the conduit 60 will finally be retained by the screen 40 in the wall 4 and collected in the collecting chamber 5. When the collecting chamber 5 is filled up with material 8 or the coarse debris container 50 is filled up, whatever comes first, the collecting device 1 is retrieved to the surface for emptying. The collecting device 1 is also retrieved to the surface for emptying when the settled material 8 has been removed from the production tubing 9 and other operations may be carried out.

In all embodiments, silt is separated from liquid over the screen 40. Excess liquid is forced out of the collecting chamber 5 due to the overpressure created by the pump 6. Silt is retained on the inner side of the screen 40.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. A movable collecting device for downhole separation and removal of particulate matter from a petroleum well, the collecting device having a first end portion and a second end portion, an exterior and an interior; the collecting device comprising:

an outer wall extending axially from the first end portion and to the second end portion, a portion of the outer wall surrounding a collecting chamber;

a nose at the first end portion comprises at least one external inlet, the external inlet being in fluid communication with the collecting chamber;

a drive unit (3) positioned at the second end portion; said drive unit is provided with energy from an electrical cable or from a wire line tractor, said electrical cable extending down into the petroleum well; and a pump for transporting the particulate matter from the exterior of the collecting device through the external inlet, through the pump and a pump outlet at a pressure side of the pump and to an interior of the collecting device, wherein the portion of the outer wall surrounding the collecting chamber comprises a screen (40) for fluid communication between the collecting chamber and the exterior of the collecting device through the portion of the outer wall.

2. The collecting device according to claim 1, wherein an axial conduit extending inside the collecting chamber forms said fluid communication between said external inlet and the suction side of said pump.

3. The collecting device according to claim 1, wherein said collecting device comprises the collecting chamber, and at its first end portion an additional closed coarse debris container which is in fluid communication with the external inlet through a check valve, and the coarse debris container is in fluid communication with a suction side of said pump.

4. The collecting device according to claim 3, wherein an axial conduit provides for said fluid communication between said coarse debris container and the suction side of said pump.

5. The collecting device according to claim 4, wherein a free end portion of said conduit extends into said coarse debris chamber from said collecting chamber through a partition wall between said collecting chamber and said coarse debris chamber.

6. The collecting device according to claim 5, wherein said free end portion is surrounded by a coarse filter.

7. The collecting device according to claim 3, wherein said screen substantially forms the outer wall extending from said coarse debris chamber to said drive unit.

8. The collecting device according to claim 1, wherein said screen substantially forms said outer wall.

9. The collecting device according to claim 1, wherein said screen is a wire-wrapped screen.

10. The collecting device according to claim 1, wherein said screen is a premium screen.

11. Use of a screen to form at least a portion of an outer wall surrounding a collection chamber in a movable collection device according to claim 1.

12. Use of a screen according to claim 11, wherein the screen substantially forms the outer wall.

13. Use of a screen according to claim 11, wherein the screen is a wire-wrapped screen.

14. Use of a screen according to claim 11, wherein the screen is a premium screen.

15. A movable collecting device for downhole separation and removal of particulate matter from a petroleum well, the collecting device having a first end portion and a second end portion, an exterior and an interior; the collecting device comprising:

an outer wall extending axially from the first end portion and to the second end portion, a portion of the outer wall surrounding a collecting chamber;

a nose at the first end portion comprises at least one external inlet, the external inlet being in fluid communication with the collecting chamber;

a drive unit positioned at the second end portion; and a pump for transporting the particulate matter from the exterior of the collecting device to the interior of the collecting device through the external inlet, a closed coarse debris container located in the first end portion and in fluid communication with the external inlet through a check valve and in fluid communication with a suction side of the pump; and a screen substantially forming the outer wall extending from the coarse debris chamber to the drive unit, the wire-wrapped screen being in fluid communication with the collecting chamber and the exterior of the collecting device.

16. The collecting device according to claim 15, wherein said at least one external inlet is in fluid communication with the suction side of the pump and the collecting chamber is in fluid communication with a pressure side of the pump.

17. The collecting device according to claim 15, wherein an axial conduit extending inside the collecting chamber forms the fluid communication between the at least one external inlet and the suction side of the pump.

18. The collecting device according to claim 15, wherein an axial conduit provides for the fluid communication between the coarse debris container and the suction side of the pump.

19. The collecting device according to claim 18, wherein a free end portion of a conduit extends into the coarse debris chamber from the collecting chamber through a partition wall between the collecting chamber and the coarse debris chamber.

20. The collecting device according to claim 19, wherein said free end portion is surrounded by a coarse filter.

21. The collecting device according to claim 15, wherein said screen is a wire-wrapped screen.

22. The collecting device according to claim 15, wherein said screen is a premium screen.

* * * * *